US009004147B2

(12) United States Patent
Kitamura et al.

(10) Patent No.: US 9,004,147 B2
(45) Date of Patent: Apr. 14, 2015

(54) METHOD AND APPARATUS FOR PRESS CASTING

(71) Applicant: Honda Motor Co., Ltd., Minato-ku, Tokyo (JP)

(72) Inventors: Takunori Kitamura, Wako (JP); Hiroomi Yanagita, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 13/968,646

(22) Filed: Aug. 16, 2013

(65) Prior Publication Data

US 2014/0054000 A1 Feb. 27, 2014

(30) Foreign Application Priority Data

Aug. 27, 2012 (JP) ..... 2012-186444

(51) Int. Cl.
*B22D 18/02* (2006.01)
*B22D 17/00* (2006.01)
*B22D 27/11* (2006.01)

(52) U.S. Cl.
CPC ..... *B22D 18/02* (2013.01); *B22D 27/11* (2013.01)

(58) Field of Classification Search
CPC ..... B22D 27/11; B22D 18/02
USPC ..... 164/113, 119, 120, 169, 172, 173, 207, 164/284, 303, 305
See application file for complete search history.

(56) References Cited

U.S. PATENT DOCUMENTS 4,986,338 A * 1/1991 Yamauchi et al. ..... 164/457

FOREIGN PATENT DOCUMENTS

CN 1562528 A * 1/2005
JP 2005-125401 A 5/2005

OTHER PUBLICATIONS

English Machine Translation of CN1562528A.*

* cited by examiner

*Primary Examiner* — Kevin P Kerns
*Assistant Examiner* — Steven Ha
(74) *Attorney, Agent, or Firm* — Carrier Blackman & Associates, P.C.; Joseph P. Carrier; William D. Blackman

(57) ABSTRACT

An apparatus for press casting includes a casting mold formed of a fixed mold and a first moving mold operable to move relative to the fixed mold. The apparatus further includes a second moving mold operable to move relative to the first moving mold. A mold cavity, which forms a cast product, is configured by the fixed mold and the second moving mold. When the first moving mold is moved to a first predetermined position, a molten metal passage and a gas exhaust port, which communicate with the mold cavity, are formed at positions outside the mold cavity. A communication between the mold cavity and the molten metal passage, and the gas exhaust port is cut off by the second moving mold when the second moving mold is moved to a second predetermined position while the first moving mold is maintained at the first predetermined position thereof.

14 Claims, 6 Drawing Sheets

< mold open state >

< mold closed state >

< initial state of pouring molten metal >

< fully filled up by pouring molten metal >

< pressurization and cut-off >

METHOD AND APPARATUS FOR PRESS CASTING

CROSS-REFERENCE TO RELATED APPLICATIONS

The present invention claims priority under 35 USC 119 based on Japanese patent application No. 2012-186444, filed on Aug. 27, 2012. The entire subject matter of this priority document, including specification claims and drawings thereof, is incorporated by reference herein.

BACKGROUND OF THE INVENTION

1. Field of the Invention

The present invention relates to a method and an apparatus for press casting. More particularly, the present invention relates to a method and an apparatus for press casting for solidifying a molten metal material which is poured into a mold cavity so as to be pressed by a moving mold.

2. Description of the Background Art

There is known apparatus for press casting, which constitutes a mold cavity forming the shape of a cast product with a fixed mold and a moving mold, and solidifies a molten metal material poured into the mold cavity so as to be pressed by the moving mold.

An example of an apparatus for press casting, in which a gate of a molten metal material is provided on a fixed mold; and a cutting-off portion of a molten metal material and a gas exhaust passage are provided on a moving mold, is disclosed in the Japanese Laid-open Patent Publication No. 2005-125401.

However, in the apparatus for press casting as described in Japanese Laid-open Patent Publication No. 2005-125401, it is necessary to form a pouring port, a gas exhaust port and the like for each product mold, and further to incorporate the mechanism for solidifying the molten metal so as to be pressed. Accordingly, such apparatus is likely to cause the increase in size and complication of the apparatus for press casting itself.

Moreover, the apparatus for press casting is unsuitable to relatively small components used for motorcycles and the like. In addition, if it is often requested to change only a part of a mold cavity as in the case of making a plurality of prototypes and the like, it is difficult to respond to such a request with the above-mentioned apparatus for press casting.

The present invention has been made to overcome the drawbacks of the existing apparatus for press casting. Accordingly, it is one of the objects of the present invention to provide a method and apparatus for press casting which is relatively simple, small in size as well as highly versatile, and is capable of pouring, cutting off a molten metal material and exhausting gas efficiently.

SUMMARY OF THE INVENTION

In order to achieve the above objects, the present invention according to a first aspect thereof provides an apparatus for press casting (1) including a casting mold which is composed of a fixed mold (11) and a first moving mold (9) whose position relative to the fixed mold (11) is movable with a first pressurizing unit (6), a second moving mold (10) whose position relative to the first moving mold (9) is movable with a second pressurizing unit (7), and the fixed mold (11) and the second moving mold (10) forming a mold cavity (26) therebetween, the mold cavity being configured to form a cast product (50*a*) when a molten metal material (50) is poured therein.

The present invention according to a second aspect thereof is characterized in that when the first moving mold (9) is moved to a first predetermined position in contact with the fixed mold (11), a molten metal passage (23) and a gas exhaust port (22), which communicate with the mold cavity (26), are formed at the position outside the mold cavity (26) and between the first moving mold (9) and the fixed mold (11).

The present invention according to a third aspect thereof is characterized in that when the second moving mold (10) is moved to a second predetermined position while the first moving mold (9) is maintained in the first predetermined position, the configuration is such that communication between the mold cavity (26) and the molten metal passage (23) and between the mold cavity and the gas exhaust port (22) is cut off by the second moving mold (10).

The present invention according to a fourth aspect thereof is characterized in that the gas exhaust port (22) is provided on the upper side of the mold cavity (26), and the molten metal passage (23) is provided on the lower side of the mold cavity (26).

The present invention according to a fifth aspect thereof is characterized in that the first pressurizing unit (6) and the second pressurizing unit (7) are each configured with a hydraulic mechanism.

The present invention according to a sixth aspect thereof is characterized in that the cut-off of the communication and pressurization of solidification of the molten metal material (50) are simultaneously carried out by moving the second moving mold (10) to the second predetermined position.

The present invention according to a seventh aspect thereof is characterized in that the apparatus further comprises a stopper (10*a*) formed on the second moving mold (10); and a stepped portion (9*a*) formed on the first moving mold (9), and that the first predetermined position is determined such that the fixed mold (11) abuts on the first moving mold (9), and the second predetermined position is determined such that the stopper (10*a*) formed on the second moving mold (10) abuts on the stepped portion (9*a*) formed on the first moving mold (9).

Moreover, the present invention according to an eighth aspect thereof provides a method for press casting using the apparatus for press casting (1) including the casting mold which is composed of the fixed mold (11); the first moving mold (9) whose position relative to the fixed mold (11) is movable with the first pressurizing unit (6); and the second moving mold (10) whose position relative to the first moving mold (9) is movable with the second pressurizing unit (7), the method for press casting includes steps of moving the first moving mold (9) to the first predetermined position in proximity to the fixed mold (11) with the first pressurizing unit (6); fully filling up by pouring the molten metal material (50) into the mold cavity (26); cutting off the communication between the molten metal passage (23) and the gas exhaust port (22), which are formed outside the mold cavity (26), by moving the second moving mold (10) with the second pressurizing unit (7); and solidifying the molten metal material (50) within the mold cavity (26) so as to be pressed by moving the second moving mold (10) to the second predetermined position with the second pressurizing unit (7).

Effects of the Invention

According to the first aspect of the present invention, the apparatus includes the second moving mold whose position relative to the first moving mold is movable with the second pressurizing unit, and the mold cavity, which forms the cast product by pouring the molten metal material, is configured by the fixed mold and the second moving mold. Thus, it is possible to change the shape on one surface side of the mold cavity by changing the second moving mold and to change a part of component's shape without changing the entire apparatus. Hence, it becomes possible to easily change the design of casting components and to provide a highly-versatile apparatus for press casting which is suited for such as manufacturing ranging from a small amount of products like prototypes to mass products and the like.

According to the second aspect of the present invention, when the first moving mold is moved to the first predetermined position in contact with the fixed mold, the molten metal passage and the gas exhaust port, which communicate with the mold cavity, are formed at the position outside the mold cavity as well as between the first moving mold and the fixed mold. Accordingly, it is not necessary to provide the second moving mold with the molten metal passage or the gas exhaust passage, and it becomes possible to easily change the design of the second moving mold.

According to the third aspect of the present invention, the configuration is such that the communication between the mold cavity, and the molten metal passage and the gas exhaust port is cut off by the second moving mold when the second moving mold is moved to the second predetermined position with the first moving mold positioned in the first predetermined position. Accordingly, it becomes possible to cut off the coagulation in the portions of the molten metal passage and the gas exhaust port from the cast product within the mold cavity in conjunction with the pressurized solidification process of the molten metal material within the mold cavity. Accordingly, it is not necessary to carry out an additional cut-off operation after ejecting the cast product from the casting mold, which thereby can reduce the production processes.

According to the fourth aspect of the present invention, the gas exhaust port is provided on the upper side of the mold cavity, and the molten metal passage is provided on the lower side of the mold cavity, which thereby can efficiently pour the molten metal material and also expel exhaust gas.

According to the fifth aspect of the present invention, the first pressurizing unit and the second pressurizing unit are configured with the hydraulic mechanism, which thereby can handle various specifications by using the highly versatile apparatus such as hydraulic jack, and reduce the production cost of the apparatus for press casting.

According to the sixth aspect of the present invention, the cut-off of the communication and the pressurization of solidification of the molten metal material are simultaneously carried out by moving the second moving mold to the second predetermined position. Thus, it becomes unnecessary to carry out an additional operation of cutting off the coagulation in the portions of the molten metal passage and the gas exhaust passage from the cast product within the mold cavity, which thereby can reduce the production processes. Further, the pressure is applied during the solidification of the molten metal, which thereby can suppress the sink mark and the gas pocket, enhance the transfer precision of shape and also can reduce the misrun and the poor filling.

According to the seventh aspect of the present invention, the first predetermined position is determined such that the fixed mold abuts on the first moving mold, and the second predetermined position is determined such that the stopper formed on the second moving mold abuts on the stepped portion formed on the first moving mold. Accordingly, it becomes easy to precisely adjust the positions of the first moving mold and the second moving mold even if the pressure is applied with great power such as a hydraulic jack.

According to the eighth aspect of the present invention, the method for press casting includes the procedure for moving the first moving mold to the first predetermined position in proximity to the fixed mold with the first pressurizing unit; the procedures for fully filling up by pouring the molten metal material into the mold cavity; the procedure for cutting off the communication between the molten metal passage and the gas exhaust port, which are formed outside the mold cavity, by moving the second moving mold with the second pressurizing unit; and the procedure for solidifying the molten metal material within the mold cavity so as to be pressed by moving the second moving mold to the second predetermined position with the second pressurizing unit.

Accordingly, the second moving mold is provided separately from the first moving mold, which thereby makes it possible to simultaneously carry out the operation to cut off the molten metal passage and the gas exhaust port from the molten metal material within the mold cavity and the operation to form the cast product by solidifying the molten metal material within the mold cavity so as to be pressed.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION OF ILLUSTRATIVE EMBODIMENTS

Figure 1:
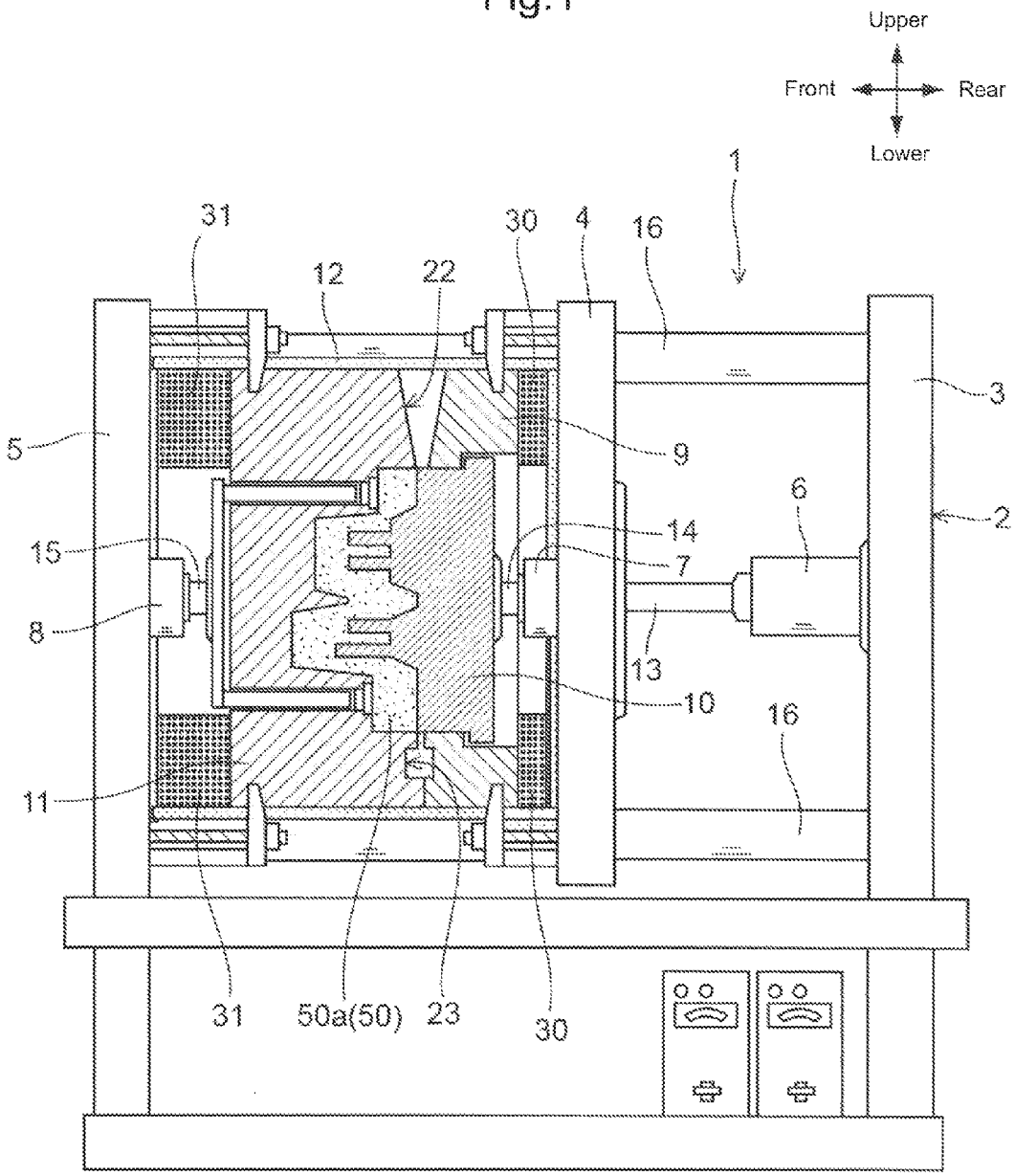
FIG. 1 is a partial left cross-sectional view of an apparatus for press casting according to an illustrative embodiment of the present invention.

An illustrative embodiment of the present invention will be described hereinafter in detail with reference to the accompanying drawings. FIG. 1 is a partial left cross-sectional view of an apparatus for press casting 1 according to the embodiment of the present invention. In the following discussion, it is described that the left direction shown in the drawing is the front direction of the apparatus for press casting 1 and the right direction shown in the drawing is the rear direction of the apparatus for press casting 1.

The apparatus for press casting 1 is an apparatus for producing a cast product 50*a* by pouring a molten metal material 50 made of molten metal such as aluminum into a mold cavity, which is formed between a fixed mold 11 and a moving mold 9 (also referred to as a first moving mold 9), and by solidifying the molten metal material so as to be pressed. In the present embodiment is characterized in that the mold cavity portion, which forms the shape of the product 50*a*, is provided with a second moving mold 10, which is movable relative to the first moving mold 9. The second moving mold 10 is movable separately from the first moving mold 9.

The apparatus for press casting 1 includes a body frame 2. The body frame 2 has a front wall 5 and a rear wall 3 which are fixed on the bed portion. A connecting frame 16, which connects the front and rear walls 5, 3 so as to be directed in the front-rear direction of the apparatus for press casting 1, is provided between the front wall 5 and the rear wall 3. A moving wall 4, which is slidable in the front-rear direction along the connecting frame 16, is engaged with the connecting frame 16. A first hydraulic jack 6, functioning as a first pressurizing unit 6, is fixed on the rear wall 3. The end of a pushing rod 13, which is extended and contracted by the operation of the first hydraulic jack 6, is connected to the moving wall 4. With such configuration, the moving wall 4 is slidable in the front-rear direction in accordance with the operation of the first hydraulic jack 6.

The fixed mold 11 and the first moving mold 9 are prepared for the start of casting in a state in which thickness adjusting members 30, 31 are sandwiched between both end portions in the front-rear direction thereof, and the front, rear, top and bottom thereof are surrounded by an outer frame 12. With such configuration, the outer frame 12 is pressed between the front wall 5 and the moving wall 4 when the moving wall 4 is pushed to the front side by the first hydraulic jack 6.

A second hydraulic jack 7, functioning as a second pressurizing unit 7, is fixed on the moving wall 4. An end portion of a pushing rod 14 of the second hydraulic jack 7 is connected to the second moving mold 10. The second hydraulic jack 7 is inserted to the inner portion of the outer frame 12 from the through-hole formed in the outer frame 12. The second moving mold 10 is slidable in the front-rear direction separately from the moving wall 4 in the state in which the outer frame 12 is pushed by the moving wall 4.

A gas exhaust port 22 and a molten metal passage 23 are formed in the upper outside and lower outside positions of a mold cavity 26 respectively on the fixed mold 11 and the first moving mold 9 which are accommodated in the first predetermined position so as to be surrounded by the outer frame 12. Incidentally, a third hydraulic jack 8, which can push the back surface of the fixed mold 11 via the pushing rod 15, is attached to the front wall 5. Although the operation of pressure can be conducted by the third hydraulic jack 8 in conjunction with the second hydraulic jack 7, the operation example using only the first hydraulic jack 6 and the second hydraulic jack 7 with the third hydraulic jack 8 fixed will be described.

Figure 2:
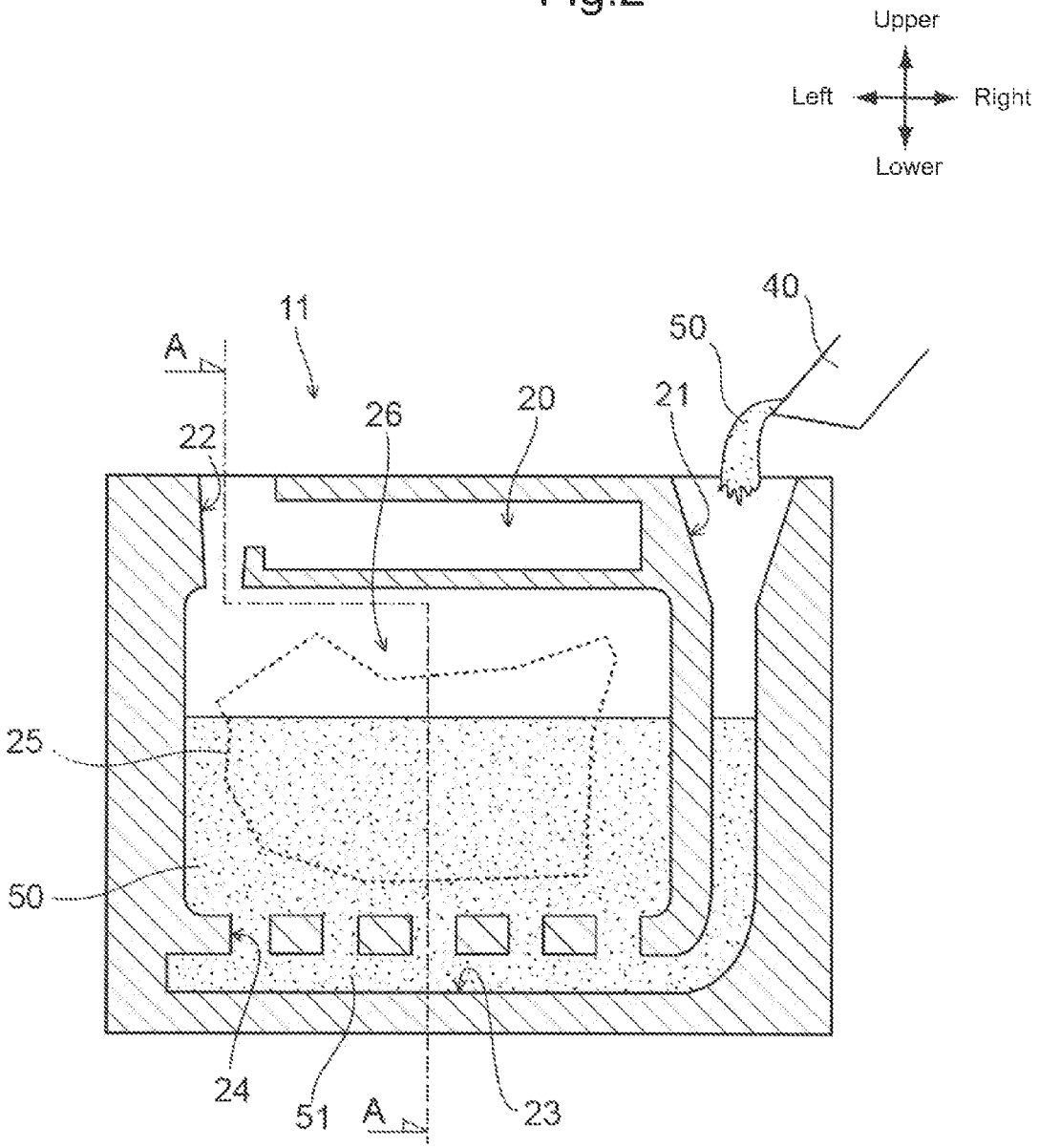
FIG. 2 is a front view of a fixed mold seen from the rear side of the apparatus for press casting.

FIG. 2 is a front view of the fixed mold 11. FIG. 2 shows the state seen from the rear side of the apparatus for press casting 1. Between the fixed mold 11 and the first moving mold 9, there are formed a mold cavity 26 which forms the shape of the product 50*a*; a gate 21 for pouring the molten metal material 50 from a container 40; the molten metal passage 23 positioned on the bottom portion as the passage for the molten metal material 50; an ingate 24 communicating from the molten metal passage 23 to the mold cavity 26; the gas exhaust port 22 through which the gas generated from the molten metal material 50 is exhausted; and a feeder-head portion 20 which is the upper reservoir for the molten metal material 50.

When the molten metal material 50 is poured from the gate 21, the mold cavity 26 having a product shape 25 is fully filled up through the ingate 24 after the molten metal passage 23 is filled up with a molten metal 51, and then the molten metal material reaches the gas exhaust port 22 and the feeder-head portion 20. Incidentally, the cross-sectional portion in the above-mentioned FIG. 1 and FIGS. 3-7 described below show the cross section corresponding to the cross-sectional view taken along a line A-A in FIG. 2.

The casting procedure by the apparatus for press casting 1 will be described hereinafter with reference to the procedure explanatory drawings in FIGS. 3-7.

Figure 3:
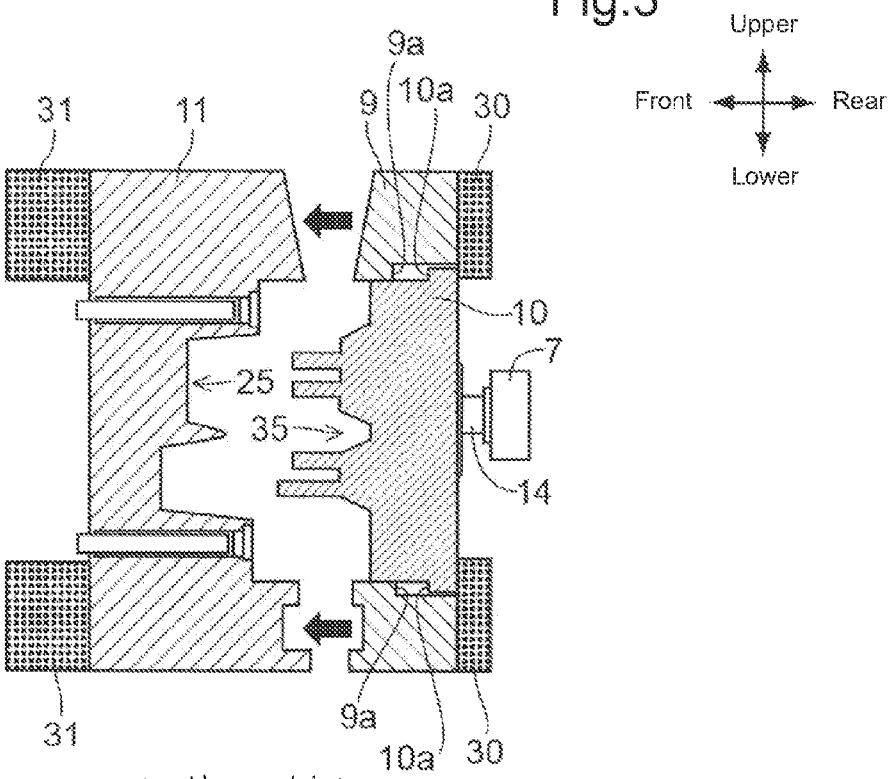
FIG. 3 is an explanatory drawing showing the mold open state.

The mold open state in FIG. 3 corresponds to the initial state in which the fixed mold 11, the first moving mold 9 and the second moving mold 10 are set in the apparatus for press casting 1. The product shapes 25, 35 are formed on the fixed mold 11 and the second moving mold 10, respectively.

The mold cavity 26 is formed between the product shape 25 of the fixed mold 11 and the product shape 35 of the second moving mold 10, while the gas exhaust port 22, the molten metal passage 23 and the like are formed between the fixed mold 11 and the first moving mold 9.

The second moving mold 10 has a contour shape which is accommodated in the opening formed substantially in the center of the first moving mold 9, and is configured so as to be slidable in the front-rear direction (in the left-right direction shown in the drawing) in the range within which a stopper 10*a* formed in the contour moves to abut on a stepped portion 9*a* of the first moving mold 9.

Incidentally, the fixed mold 11, the first moving mold 9 and the second moving mold 10 according to the present embodiment are made of graphite (black lead). Further, the thickness adjusting members 30, 31 can be changed according to the size and thickness of the fixed mold 11 and the first moving mold 9. Incidentally, the thickness adjusting member 30 on the first moving mold 9 side functions also as a stopper for restricting the movement of the second moving mold 10 toward the rear side.

Figure 4:
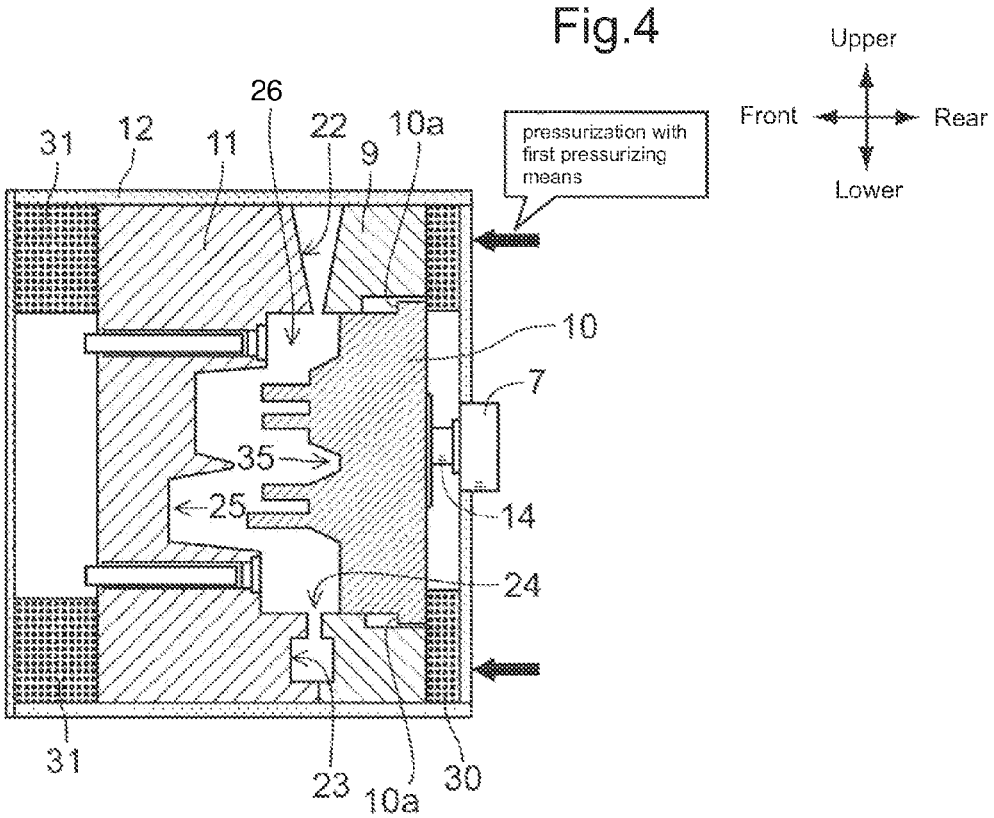
FIG. 4 is an explanatory drawing showing the mold closed state.

The mold closed state shown in FIG. 4 corresponds to the state in which each of the casting molds completes in setting and is prepared for pouring the molten metal material 50. The fixed mold 11 and the first moving mold 9, the front, rear, top and bottom of which are surrounded by the outer frame 12, are accommodated in the predetermined position in which the fixed mold 11 and the first moving mold 9 are in contact with each other. Then, the gas exhaust port 22, the molten metal passage 23, the ingate 24 and the gate 21 (see FIG. 2) are formed between the fixed mold 11 and the first moving mold 9. In this configuration, the state in which the pressure is applied from the outside of the outer frame 12 by the first pressurizing unit (first hydraulic jack) 6 and the contact surface pressure between the fixed mold 11 and the first moving mold 9 is increased is the mold closed state. The pressure applied by the first hydraulic jack 6 is transferred to the first moving mold 9 via the outer frame 12 and the thickness adjusting member 30, but not transferred to the second moving mold 10 unless the second hydraulic jack 7 is operated.

Figure 5:
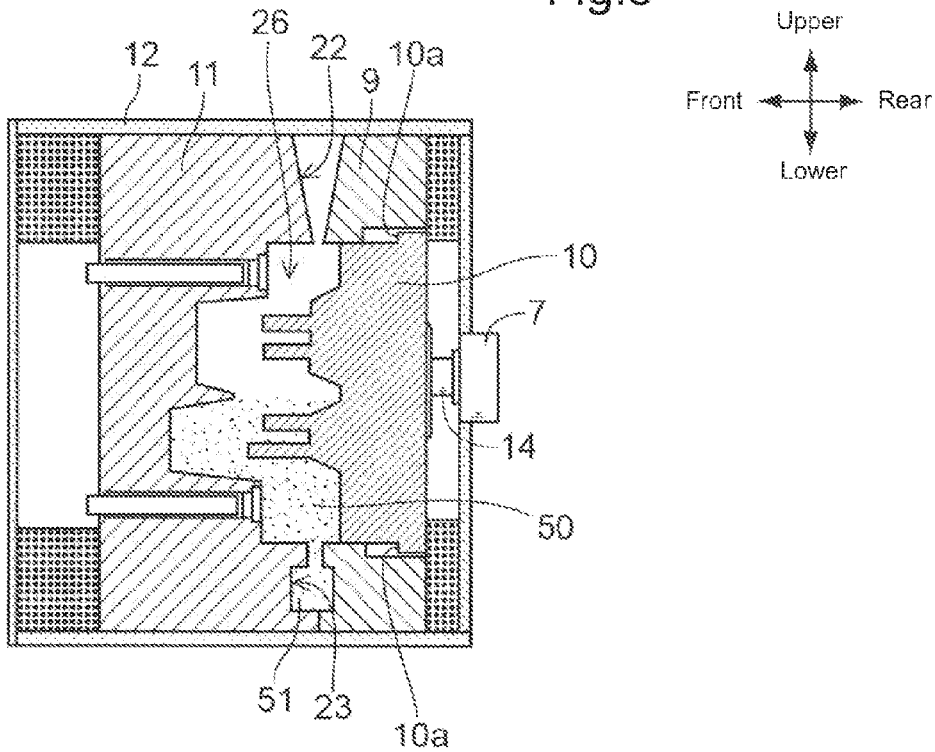
FIG. 5 is an explanatory drawing showing the state of pouring the molten metal.

The initial state of pouring the molten metal as shown in FIG. 5 is the state in which the molten metal material 50, which is poured from the gate 21, reaches up to the middle of the mold cavity 26 after filling up the molten metal passage 23.

Figure 6:
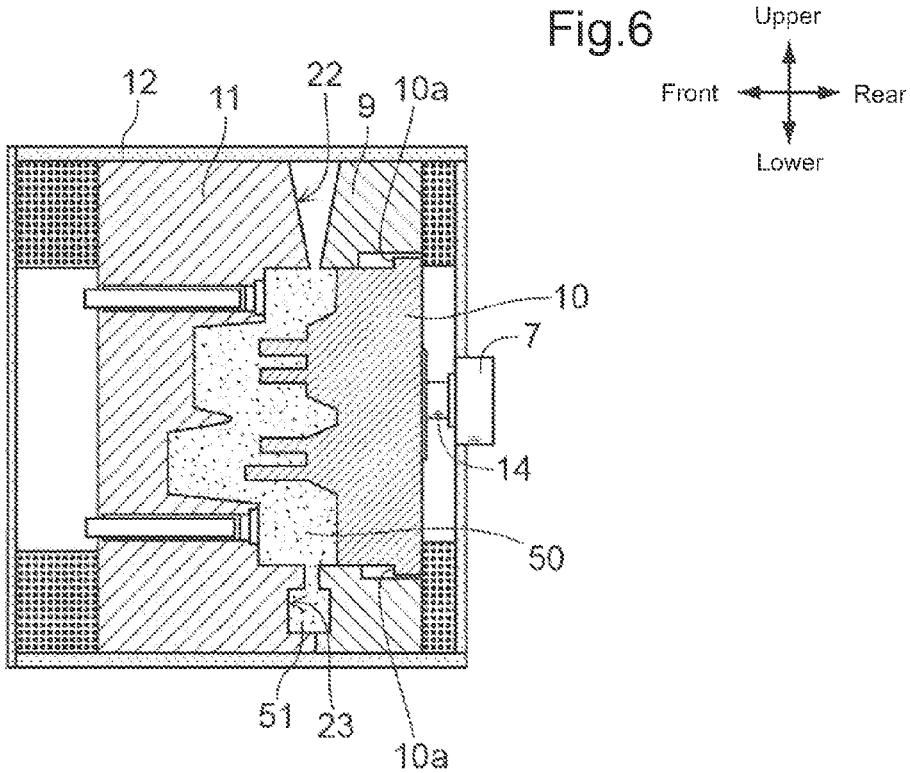
FIG. 6 is an explanatory drawing showing the fully-filled state with the poured molten metal.

The fully-filled state with the poured molten metal as shown in FIG. 6 is the state in which the molten metal material 50 is further poured and the mold cavity 26 is filled up to the upper end thereof with the molten metal material 50.

Figure 7:
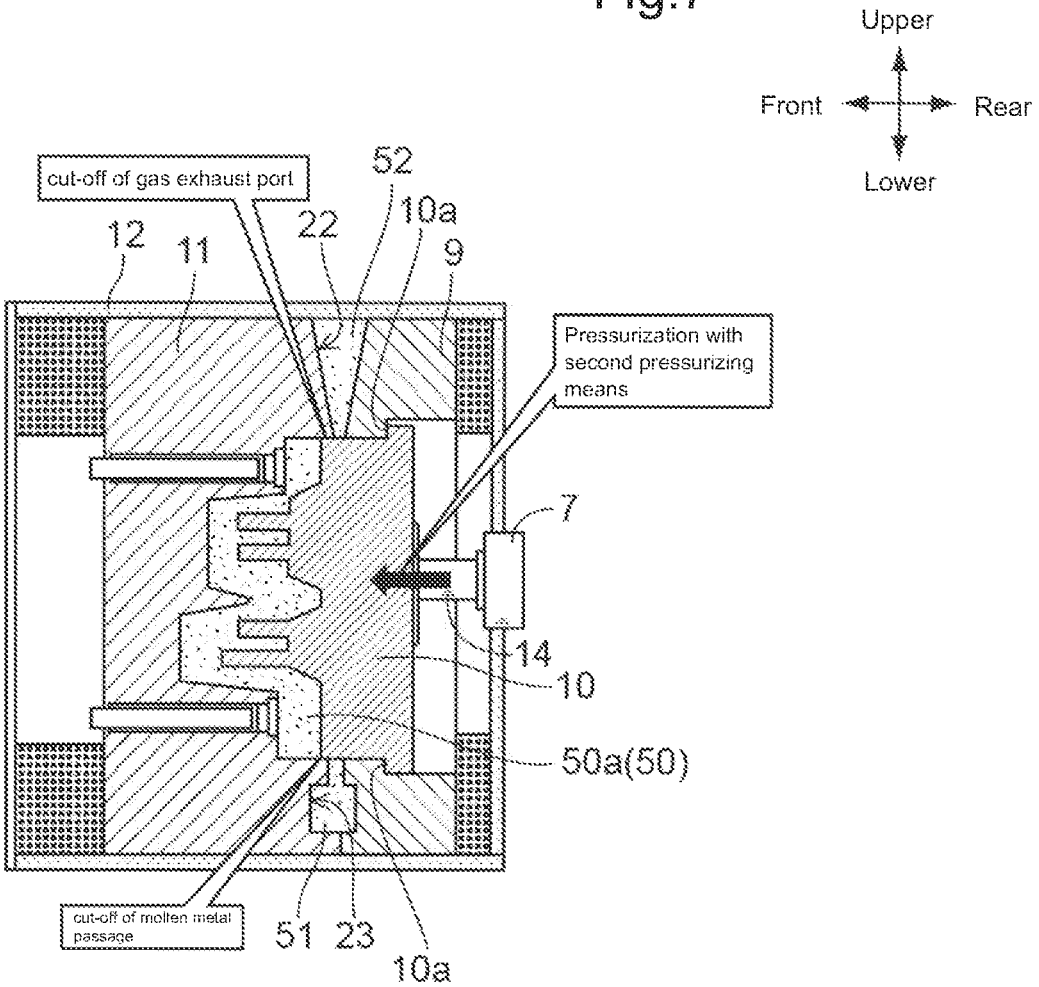
FIG. 7 is an explanatory drawing showing the state in which the molten metal is pressed and cut off.

In the pressurization and cutting-off state shown in FIG. 7, the second moving mold 10 is moved by the thin-type second pressurizing unit (second hydraulic jack) 7. As the second moving mold 10 is pushed forward, the excess 52 of the molten metal material 50 is forced out to the gas exhaust port 22, and the pressure is applied on the molten metal material 50 of the mold cavity 26. Then, when the stopper 10*a* of the second moving mold 10 is pushed up to a second predetermined position which abuts on the stepped portion 9*a* of the first moving mold 9, the molten metal 51 of the molten metal passage 23 and the excess 52 of the gas exhaust port 22 are cut off from the product 50*a* of the mold cavity 26 by the second moving mold 10. This is because the passages between the mold cavity 26 and the molten metal passage 23 and between the mold cavity 26 and the gas exhaust port 22 are respectively set to be cut off (fully-enclosed) in the course of moving the second moving mold 10 to the second predetermined position.

Here, the cut-off of each passage is carried out before reaching the second predetermined position which is determined such that the stopper 10*a* abuts on the stepped portion 9*a*. More specifically, when the second moving mold 10 is moved toward the direction of the fixed mold 11, the cut-off of each passage is carried out in advance, and subsequently the pressure is applied on the cast product 50*a* within the mold cavity 26 which is cut off. With the two-step setting, it becomes possible to simultaneously carry out 'the cut-off of the passage' and 'the pressurization of the product'.

According to the above-mentioned method for press casting, the pressurized solidification of the cast product 50*a* and the cut-off of the molten metal 51 and the excess 52 are continuously (simultaneously) carried out during the pressurization operation by the second hydraulic jack 7. More specifically, it is possible to provide the state in which unnecessary portions have already been cut off when the fixed mold 11 and the first moving mold 9 are spaced from each other and the product 50*a* is ejected from the casting mold. Therefore, it is not necessary to provide an additional process for cutting off unnecessary portions after ejecting the product 50*a* from the casting mold, which thereby can reduce the operation processes.

Further, since in the apparatus for press casting 1 according to the present embodiment, the second moving mold (product mold) 10 constituting the mold cavity 26 is provided separately from the first moving mold 9, it is possible to change the shape of one-side surface of the product 50*a* only by exchanging the second moving mold 10. With this configuration, for example, it is possible to suppress the cost for building a casting mold when making a plurality of prototypes which are partially different in shape.

Incidentally, a press casting in general is highly adhesive to casting mold by applying pressure on the molten metal material, is excellent in transfer precision, and has high resistant against the sink mark, the gas pocket and the draw of inner portion by applying pressure. Further, since the casting mold is made of graphite and the casting mold is removed not in the up-down direction but in the front-rear direction, the press casting according to the present embodiment is free from a defect of losing shape, as is often the case with the sand stripping of a sand mold. Incidentally, although the casting mold is made of graphite in the above-mentioned embodiment, the material for the casting mold may be changed according to the material to be cast.

Figure 8:
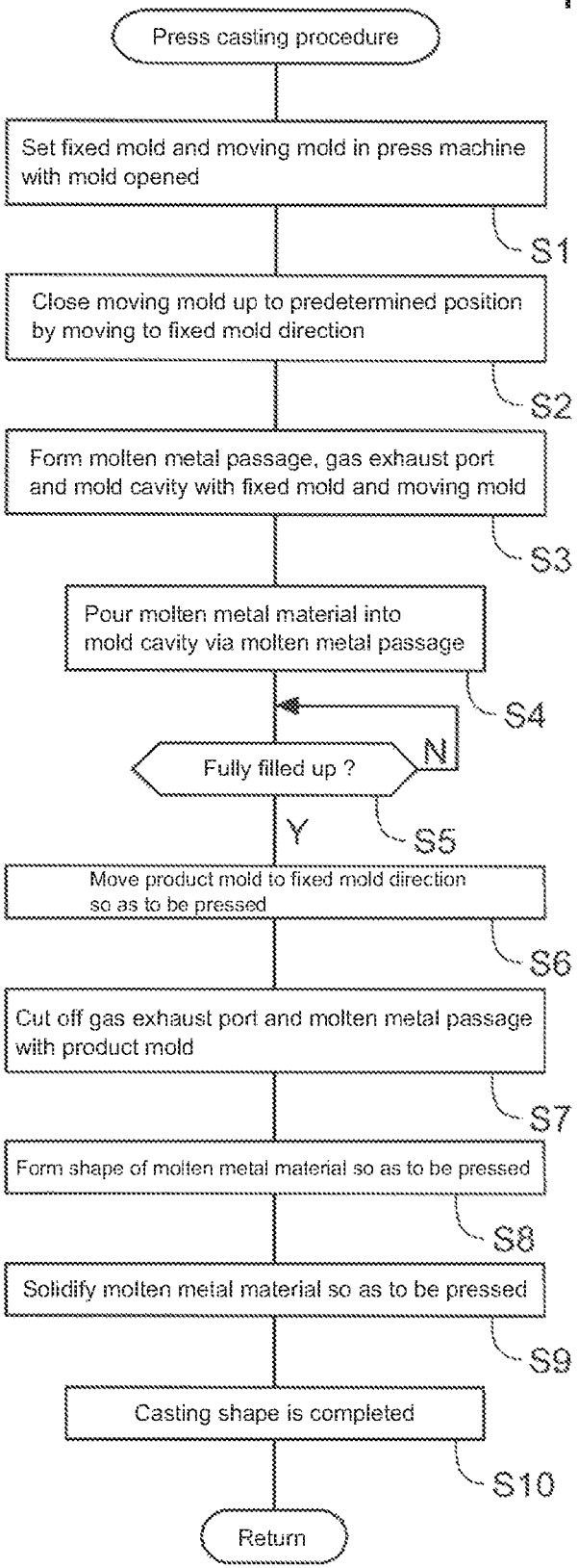
FIG. 8 is a flowchart showing the press casting procedure by the apparatus for press casting according to the illustrative embodiment of the present invention.

FIG. 8 is a flowchart showing the press casting procedure by the apparatus for press casting 1 according to the present embodiment.

In a step 1, the fixed mold 11 and the first moving mold 9 are set in the opened state in the apparatus for press casting (see FIG. 3). Next, in a step S2, the first moving mold 9 is moved to the direction of the fixed mold to be closed up to the first predetermined position. In a step S3, the molten metal passage, the gas exhaust port and the mold cavity are formed by the fixed mold and the first moving mold.

In a step S4, the molten metal material is poured into the mold cavity via the molten metal passage. In a subsequent step S5, whether the mold cavity is in the fully-filled state with the molten metal material or not is judged, the press casting procedure proceeds to a step 6 when judged as positive, or returns to the judgment in the step 5 when judged as negative.

In the step S6, the pressurized movement of the product mold (the second moving mold 10) to the fixed mold direction is started. In a step S7, the gas exhaust port and the molten metal passage are cut off by the product mold 10. Next, in a step S8, the shape of the molten metal material within the mold cavity is formed so as to be pressed. In a step S9, the molten metal material is solidified so as to be pressed by the product mold 10. In a step S10, forming the cast shape (cast product) is completed, and then a sequence of procedures is completed.

Incidentally, the configuration of the apparatus for press casting, the shape and material of the fixed mold and the first moving mold, the shape and material of the second moving mold, the configuration of the first pressurizing unit and the second pressurizing unit, and the type of the molten metal material and the like are not limited to the above-mentioned embodiment, but may be subject to various changes.

For example, the shape of the mold cavity, the molten metal passage, the ingate, the gate and the like of the fixed mold and the first moving mold can be arbitrarily changed according to the shape and the like of the cast product.

In other words, although the present invention has been described herein with respect to a number of specific illustrative embodiments, the foregoing description is intended to illustrate, rather than to limit the invention. Those skilled in the art will realize that many modifications of the illustrative embodiment could be made which would be operable. All such modifications, which are within the scope of the claims, are intended to be within the scope and spirit of the present invention.

What is claimed is:

1. In an apparatus for press casting comprising a casting mold which is composed of a fixed mold and a first moving mold whose position relative to the fixed mold is movable with a first pressurizing unit, the improvement comprising a second moving mold whose position relative to said first moving mold is movable with a second pressurizing unit;

said fixed mold and said second moving mold being configured to form a mold cavity therebetween, wherein said mold cavity forms a cast product when molten metal material is poured therein;

wherein when said first moving mold is moved to a first predetermined position in contact with said fixed mold, a molten metal passage and a gas exhaust port, which both communicate with said mold cavity, are formed at positions outside said mold cavity and between said first moving mold and said fixed mold; and wherein when said second moving mold is moved to a second predetermined position while said first moving mold is maintained at the first predetermined position, the communication between said mold cavity and said molten metal passage, and between said mold cavity and said gas exhaust port, is cut off by said second moving mold.

2. The apparatus for press casting according to claim 1, wherein said gas exhaust port is provided on an upper side of said mold cavity, and said molten metal passage is provided on a lower side of said mold cavity.

3. The apparatus for press casting according to claim 1, wherein said first pressurizing unit and said second pressurizing unit are each configured with a hydraulic mechanism.

4. The apparatus for press casting according to claim 1, wherein the cut-off of said communication and pressurization of solidification of said molten metal material are simultaneously carried out while moving said second moving mold to said second predetermined position.

5. The apparatus for press casting according to claim 1, further comprising a stopper formed on said second moving mold; and a stepped portion formed on said first moving mold;

wherein said first predetermined position is determined when said fixed mold abuts on said first moving mold, and said second predetermined position is determined when the stopper formed on said second moving mold abuts on the stepped portion formed on said first moving mold.

6. A method for press casting using an apparatus for press casting;

said apparatus for press casting comprising a casting mold comprising a fixed mold;

a first moving mold whose position relative to the fixed mold is movable with a first pressurizing unit;

a second moving mold whose position relative to the first moving mold is movable with a second pressurizing unit; and said fixed mold and said second moving mold forming a mold cavity therebetween;

wherein when said first moving mold is moved to a first predetermined position in contact with said fixed mold, a molten metal passage and a gas exhaust port, which communicate with said mold cavity, are formed at positions outside said mold cavity;

the method for press casting comprising the steps of moving said first moving mold to the first predetermined position in proximity to said fixed mold with said first pressurizing unit;

filling up a molten metal material into said mold cavity;

cutting off a communication between said molten metal passage and said gas exhaust port by moving said second moving mold with said second pressurizing unit; and solidifying the molten metal material within said mold cavity so as to be pressed by said second moving mold while moving said second moving mold to a second predetermined position with said second pressurizing unit.

7. A method for press casting according to claim 6, wherein the step of filling up the molten metal material into said mold cavity includes pouring the molten metal material into said mold cavity and fully filling up said mold cavity with the molten metal material.

8. A method for press casting according to claim 6, wherein said gas exhaust port is provided on the upper side of said mold cavity, and said molten metal passage is provided on the lower side of said mold cavity.

9. A method for press casting according to claim 6, wherein each of said first pressurizing unit and said second pressurizing unit comprises a hydraulic jack.

10. An apparatus for press casting, comprising a fixed mold;

a first moving mold operable to move relative to said fixed mold; and a second moving mold operable to move relative to said first moving mold;

wherein said fixed mold and said second moving mold form a mold cavity therebetween;

wherein when said first moving mold is moved to a first predetermined position in contact with said fixed mold, a molten metal passage and a gas exhaust port are formed at positions outside said mold cavity and between said first moving mold and said fixed mold; wherein each of said molten metal passage and said gas exhaust port communicate with said mold cavity; and wherein when said second moving mold is moved to a second predetermined position with respect to said first moving mold, the communication between said mold cavity and said molten metal passage, and between said mold cavity and said gas exhaust port, is cut off by said second moving mold.

11. An apparatus for press casting according to claim 10, wherein said gas exhaust port is provided on an upper side of said mold cavity, and said molten metal passage is provided on a lower side of said mold cavity.

12. An apparatus for press casting according to claim 10, further comprising a first pressurizing unit connected to said first moving mold; and a second pressurizing unit connected to said second moving mold.

13. An apparatus for press casting according to claim 12, wherein each of said first pressurizing and said second pressurizing unit comprises a hydraulic jack.

14. An apparatus for press casting according to claim 13, further comprising a third hydraulic jack connected to said fixed mold.

* * * * *